US006040543A

United States Patent [19]

Mina et al.

[11] Patent Number: 6,040,543

[45] Date of Patent: Mar. 21, 2000

[54] EXPLOSION PROOF TOGGLE SWITCH

[75] Inventors: Nabil L. Mina, Roselle; Santosh Vilanilam, Hinsdale; Garrett S. Yarbrough, Chicago, all of Ill.

[73] Assignee: EGS Electrical Group LLC, Skokie, Ill.

[21] Appl. No.: 09/373,948

[22] Filed: Aug. 13, 1999

[51] Int. Cl.[7] ..... H01H 21/80

[52] U.S. Cl. ..... 200/559; 200/339

[58] Field of Search ..... 200/6 R–6 C, 200/16 R–16 D, 553, 339, 557–562

[56] References Cited

U.S. PATENT DOCUMENTS

| | | | |
|---|---|---|---|
| 2,690,486 | 9/1954 | Wilckens | 200/89 |
| 2,786,912 | 3/1957 | Healy | 200/67 |
| 4,133,993 | 1/1979 | Judd | 200/153 K |
| 4,359,611 | 11/1982 | Haskins | 200/1 TK |
| 5,906,272 | 5/1999 | Kurek | 200/559 |

*Primary Examiner*—Michael Friedhofer
*Attorney, Agent, or Firm*—Jones Day, Reavis & Pogue

[57] ABSTRACT

A toggle switch includes a main housing that contains an electrical contact assembly operated by a cam member which opens and closes the contacts through movement of a leaf spring. The switch further includes a modular assembly of a housing cover to which a manually operable pivotable handle is mounted and is connected to a rotatable bushing supported shaft. The shaft operates a gear set attached to the cam member. The contacts provide an electrical connection to terminals that are insert molded into the housing. The terminals are configured to be provided with wire connecting screws accessible from the rear of the housing. The switch is thus explosion proof in construction and the rear mounted terminal screws avoid the possibility of shorting the live terminals to an associated metal electrical box. The switch is also readily constructed by known manufacturing methods and is capable of being directly installed in a standard electrical box thus avoiding the need for a separate explosion proof enclosure.

10 Claims, 4 Drawing Sheets

EXPLOSION PROOF TOGGLE SWITCH

BACKGROUND OF THE INVENTION

1. Field of the Invention

The present invention relates generally to electrical toggle switches of a type normally used to control AC power to resistive and inductive loads, motor loads and lighting, or the like, and more particularly to a toggle switch which is specifically designed to be used in potentially explosive environments.

2. Description of the Related Art

Toggle switches of various types have long been used to control AC power in domestic, commercial and industrial applications for operating various electrical devices and equipment. Known toggle switches typically are manufactured with a dielectric housing that contains electrical contacts and is fitted with a manually operable handle to switch power to externally mounted terminals. In one common form of toggle switch the handle has a cam surface internal to the housing that actuates a metallic leaf spring which in turn makes or breaks electrical conductivity with the contacts. Common toggle switches are standardized in terms of their mounting configurations such that they can readily be installed in wall-mounted electrical boxes, for example, with only the use of two screws. Typically, screw terminals are positioned on the sides of the switch housing such that connection can be easily made to electrical wires of suitable size to deliver AC power to electrical devices or equipment.

The common toggle switch is generally unacceptable for use by itself in an environment that can contain potentially explosive gases. This is so because the housing is generally not designed to allow gases that result from contact arcing to circulate within the housing and exit at a temperature that is below the ignition temperature of the surrounding gases. Accordingly, where conventional toggle switches are used in potentially explosive environments they generally must be housed in a specially designed enclosure. Not only can such enclosures be expensive to manufacture, they are not capable of being fitted into a standard electrical box, and therefore, they must be specially installed at additional cost to the user. In addition, common forms of toggle switches have side mounted electrical terminals for connection to electrical wiring. These terminals can short circuit to metal boxes in which the toggle switches are installed unless extra steps are taken to protect them using electrical tape or the like. Accordingly, it is desirable to provide a toggle switch of a unique construction which is not only explosion proof when used in an explosive environment but which is also of a size capable of permitting the switch to be installed conveniently in a standard, ordinary electrical box. It is also desirable to provide such a switch having a unique arrangement of terminals such that the terminals are preprotected from shorting to a metal electrical box in which the switch is installed. Still further, it is desirable to provide such a switch which is cost effective to manufacture by conventional methods.

SUMMARY OF THE INVENTION

The present invention improves over the prior art by providing a toggle switch having a main housing that contains an electrical contact assembly operated by a cam member which opens and closes the contacts through movement of a leaf spring. The switch further includes a modular assembly of a housing cover to which a manually operable pivotable handle is mounted and is connected to a rotatable shaft which is supported by a insert molded bushing. The shaft operates a gear set attached to the cam member. The contacts provide an electrical connection to terminals that are insert molded into the housing. The terminals are configured to be provided with wire connecting screws accessible from both the front and rear of the housing. The switch is thus explosion proof in construction and the front or rear mounted terminal screws avoid the possibility of shorting the live terminals to an associated metal electrical box. The switch is also readily constructed by known manufacturing methods and is capable of being directly installed in a standard, ordinary electrical box thus avoiding the need for a separate explosion proof enclosure.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
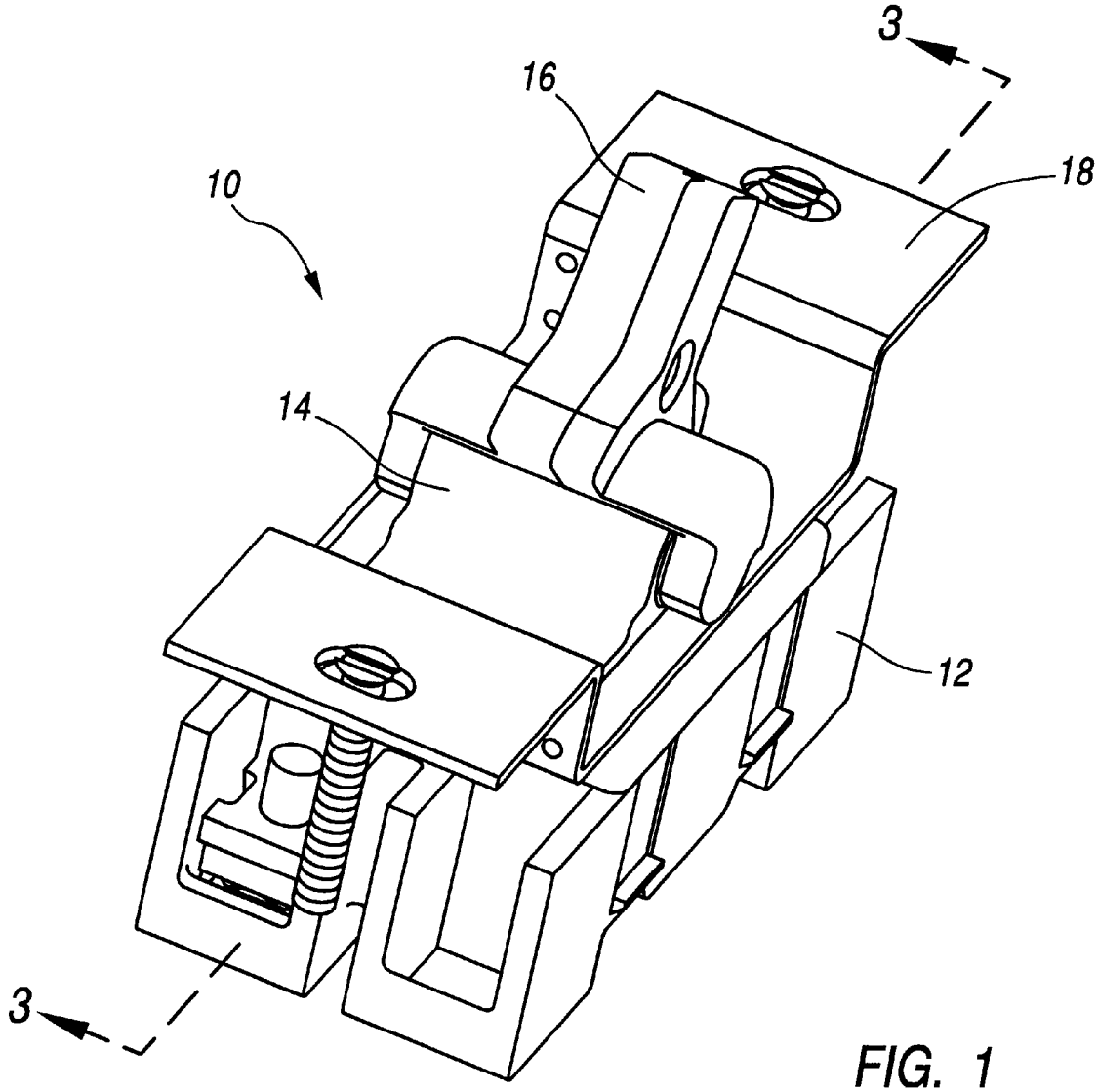
FIG. 1 is a perspective view of a toggle switch constructed in accordance with the principles of the invention showing the switch in an assembled condition.

Referring now to the drawings, and initially to FIG. 1, a toggle switch constructed according to the principles of the invention is designated generally by the reference numeral 10 and includes as its principal components a housing 12 and housing cover 14. The housing 12 and cover 14 are preferably injection molded from a suitable dielectric plastic material. The cover 14, as will be described in detail hereinafter supports a pivotable handle 16. A suitable metal bracket 18 is secured as by screws 19 passing through the housing cover 14 and into the housing 12 (see FIG. 2) to provide means for mounting the switch 10 in an electrical box (not shown).

Figure 2:
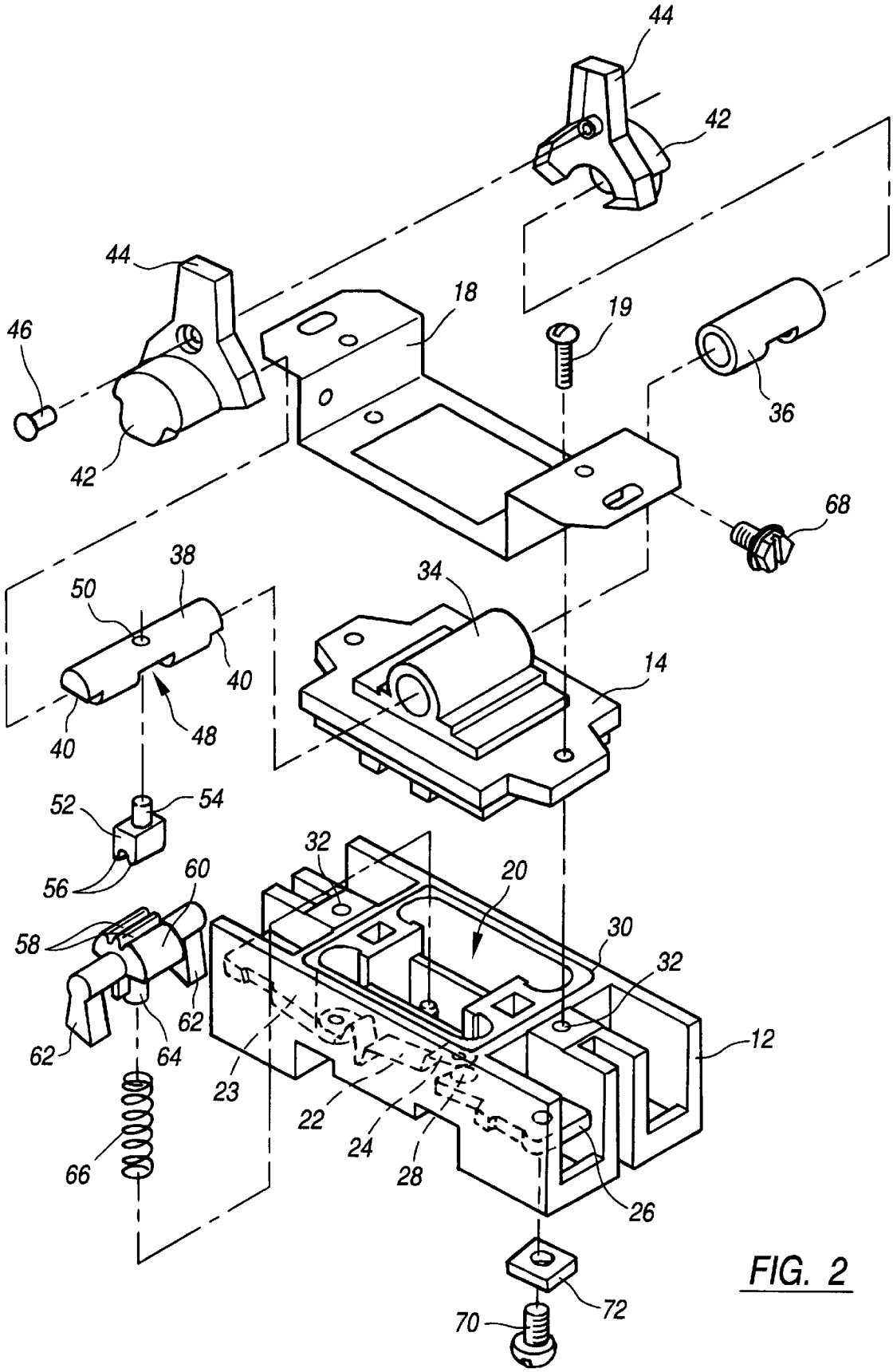
FIG. 2 is an exploded perspective view partially in phantom showing the principal components of the switch of FIG. 1.

Turning now to FIG. 2, the components of the switch 10 can be seen in exploded perspective. The housing 12 is formed with an internal cavity 20 which is dimensioned and configured to contain a metal leaf spring 22 connected at one end to a first metallic terminal 23 which exits the cavity 20. A free end 24 of the spring 22 is aligned with a second metallic terminal 26 which also exits the cavity 20 and which is provided with an electrical contact 28 lying beneath the free end 24 of the spring 22. The housing 12 is also formed with a peripheral groove 30 circumscribing the cavity 20. Also, surfaces 32 are raised slightly, and preferably on the order of 0.005 inch, providing mounting surfaces for the housing cover 14. The combination of the groove 30 and raised surfaces 32 is a known feature for allowing hot gases internal to the cavity 20 to circulate around a labyrinthal path, cool slightly and exit the cavity 20 to the environment. The raised surfaces 32 serve to reduce explosion pressure within the cavity 20 as based on suitable explosion tests.

The cover 14 can be seen to be an integrally molded member provided with an upper journal 34. The journal 34 is dimensioned to support an insert molded bushing 36 which is preferably formed from a suitable metallic bearing material such as stainless steel. The bushing 36 is, in turn, dimensioned to slidingly receive a shaft 38. The shaft 38 is formed at its ends with flats 40 which give the shaft ends a semi-circular shape that project beyond the journal 34 and bushing 36. These semi-circular ends are received by portions 42 of handle halves 44 having internal sockets that are also semi-circular in shape. By this arrangement, the handle halves 44, when assembled, can lock to the shaft 38 and provide for its rotation in the bushing 36. The handle halves 44 are preferably secured together by a suitable rivet 46, although other means may be employed such as thermoforming or ultrasonic welding. The shaft 38 is also formed with a central recess 48 and through aperture 50 which together receive and support a drive gear 52 having a cylindrical projection 54 which passes into the aperture 50. The drive gear 52 is formed with a pair of teeth 56. The teeth 56 engage teeth 58 of a driven gear 60 supported on a shaft 61 having opposed cam members 62 formed on its ends. A projection 64 formed beneath the gear 60 serves to position a spring 66 which bears against a lower wall of the housing cavity 20 and biases the gears 52 and 60 into mating contact and positions the gear 52 within the recess 48 of the shaft 38. The mounting bracket 18 may be provided with an aperture (not shown) to threadingly receive a ground screw 68 and the terminals preferably are formed to threadingly receive screws 70, only one of which can be seen in FIG. 2, and the screws 70 are preferably provided with U-lock washers 72 to meet certain international requirements.

Figure 3A:
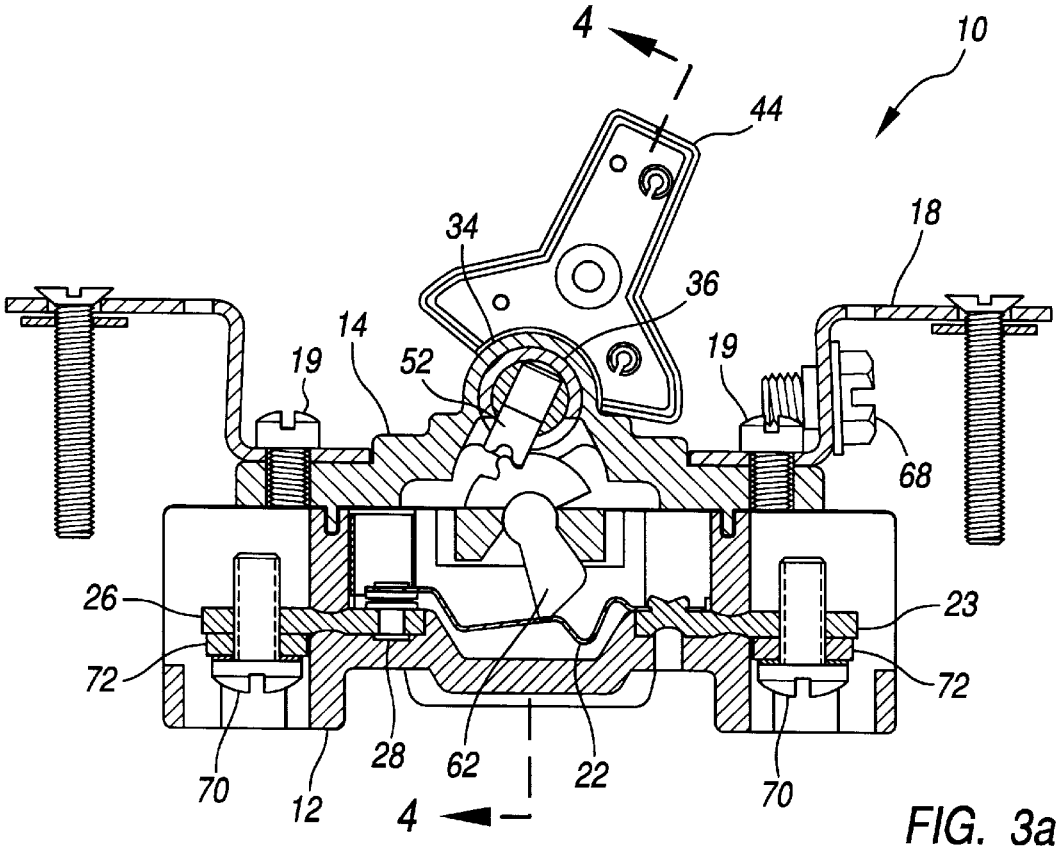
FIG. 3*a* is a cross-sectional view taken substantially along the line 3—3 of FIG. 1 showing the switch with its electrical contacts engaged.
Figure 3B:
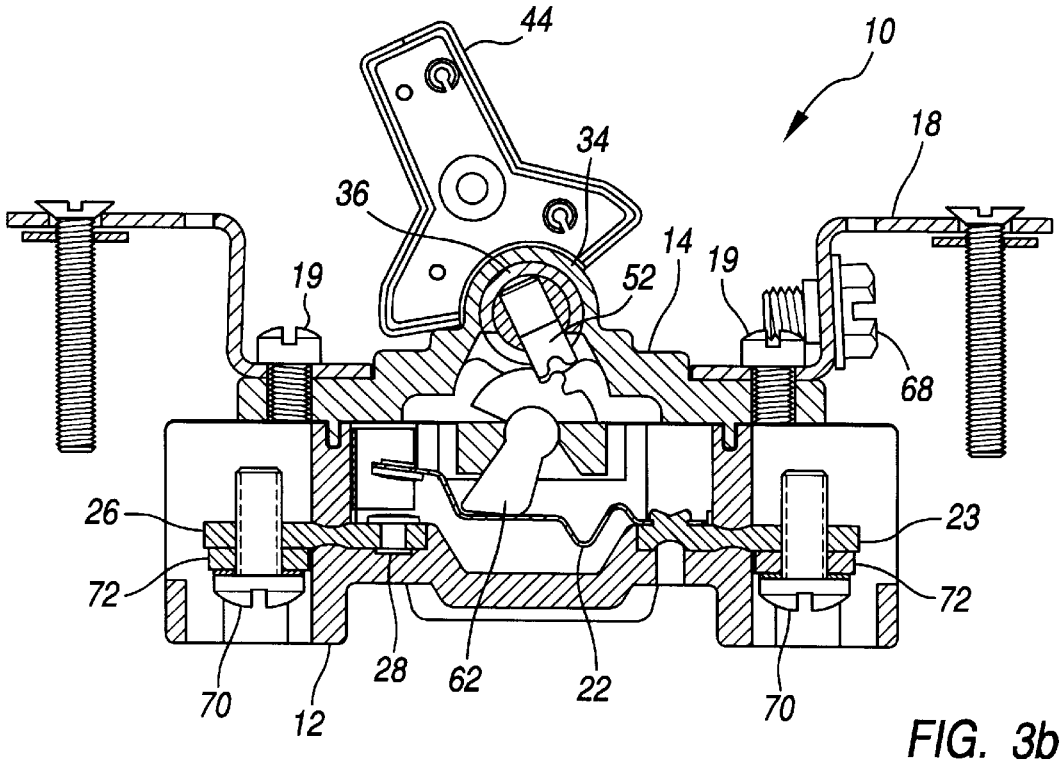
FIG. 3*b* is a cross-sectional view taken substantially along the line 3—3 of FIG. 1 showing the switch with its electrical contacts disengaged.
Figure 4:
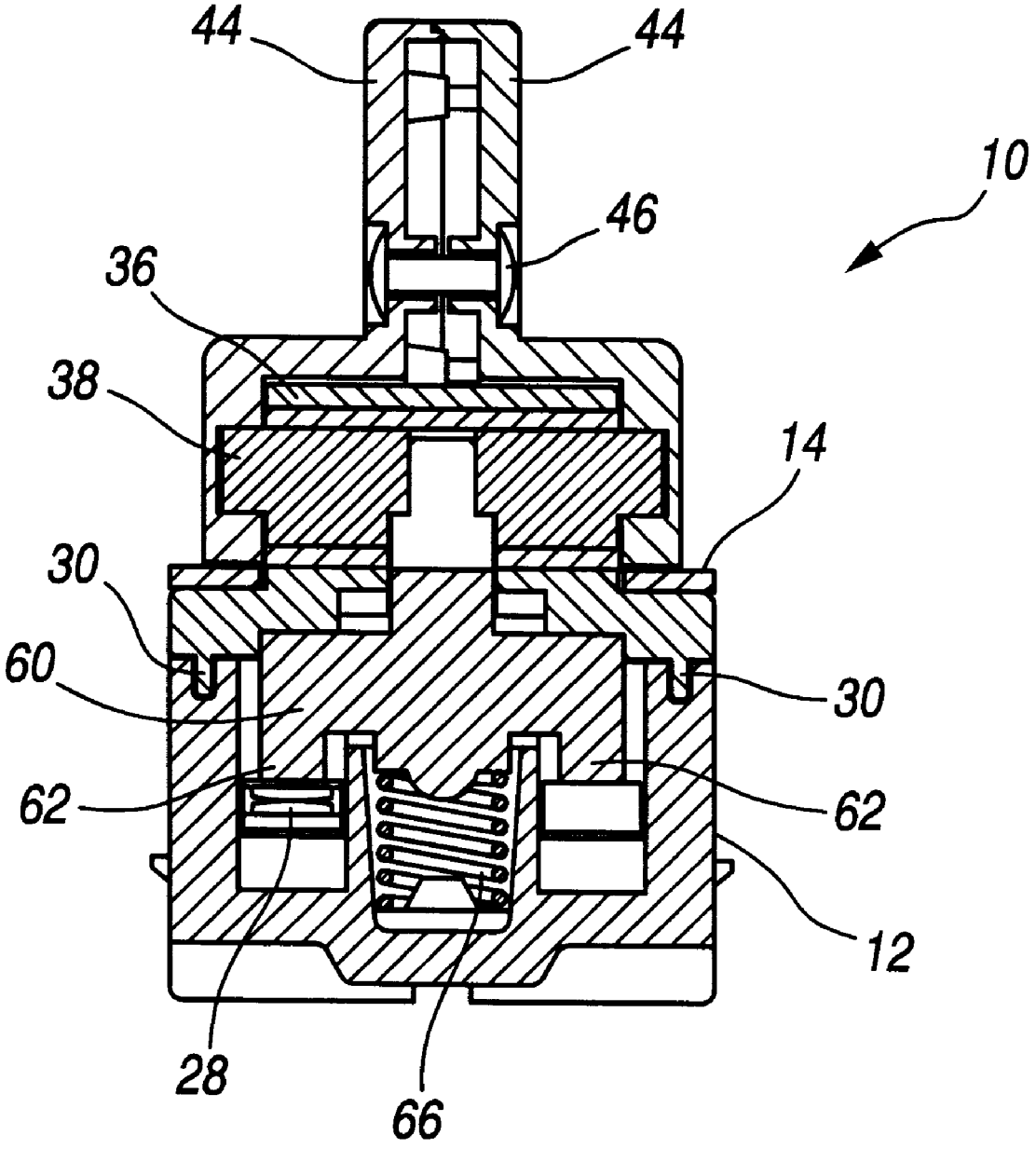
FIG. 4 is a cross-sectional view taken substantially along the line 4—4 of FIG. 3*a*.

FIG. 3*a* shows the switch 10 with the handle 16 in such a position as to rotate the cam member 62 and in turn deflect the spring 22 into engagement with the contact 28. In this configuration, the switch 10 is in the "on" position such that electrical current can flow through the terminal 23, the spring 22 and the terminal 26. FIG. 3*b* shows the switch 10 with the handle 16 in such a position that the cam member 62 is rotated to allow the spring 22 to disengage from the contact 28 thus opening the circuit and rendering the switch 10 in the "off" position. FIG. 4 shows another view of the internal components of the switch 10 as assembled.

It can now be appreciated that a switch constructed in accordance with the invention offers considerable advantages over the prior art, particularly by permitting an explosion proof construction in an assembly that can simply be substituted for a toggle switch of conventional design and size. The switch 10 is specifically designed with terminals 23 and 26 which are insert molded into the plastic housing 12 to provide for a more unitary construction. Advantageously, the terminals are accessible from either the front or rear of the housing 12 instead of from the side to prevent shorting of the terminals to an associated electrical box when they are connected to live electrical wires. Also as will be appreciated the cover 14 and handle 16 components are not only of a highly functional arrangement they are modular in construction such that they can readily be installed and removed from the housing 12 as a unitary assembly. The switch 10 is also cost-effectively manufactured by conventional fabrication and assembly methods. Although the drawing illustrates a switch 10 of a single pole single throw type, it will be understood that the switch 10 can also be conveniently converted to a double pole switch simply by installing an additional spring and pair of terminals in the housing 12. The switch 10 can also be readily converted to a three-way switch by using an L-shaped terminal and a cam having oppositely facing lobes.

While the invention has been described in connection with preferred embodiments thereof it will be apparent to those skilled in the art that many changes and modifications may be made without departing from the true spirit and scope of the present invention. Accordingly, it is intended by the appended claims to cover all changes and modifications as come within the spirit and scope of the invention.

What is claimed is:

1. A toggle switch comprising:

a housing having electrical contact means contained in a cavity thereof and operatively connectable to electrically conductive terminals extending through said housing;

a cover for covering the cavity of said housing;

said cover being formed with an integrally formed transverse journal portion;

a bushing received by said journal portion;

a shaft received by said bushing and being rotatable therein; and a pair of interconnected handle members each engaging a respective end of said shaft;

wherein said cover, bushing, shaft and handle members are removable from said housing as a unitary assembly.

2. The switch of claim 1 wherein said shaft engages a gear set which is operable to make or break the contact means within the housing cavity.

3. The switch of claim 2 wherein said gear set includes cam means engageable with at least one contact spring.

4. The switch of claim 3 wherein said gear set includes a driven gear connected by a shaft to said cam means.

5. The switch of claim 2 wherein said gear set includes a drive gear and said shaft is provided with a recess for receiving and supporting said drive gear.

6. The switch of claim 1 wherein said terminals are insert molded into said housing.

7. The switch of claim 1 wherein said unitary assembly is attachable to said housing by a pair of screws.

8. The switch of claim 1 wherein said unitary assembly also includes a bracket for attachment of said switch to an electrical box.

9. The switch of claim 1 wherein said terminals are accessible only from a rear of the housing for connection to associated electrical wires.

10. The switch of claim 1 wherein said handle members each have means for fixedly engaging said respective ends of said shaft.

* * * * *